US007494206B2

(12) United States Patent
Okazawa et al.

(10) Patent No.: US 7,494,206 B2
(45) Date of Patent: Feb. 24, 2009

(54) LIQUID EJECTION HEAD AND METHOD OF PRODUCING SAME

(75) Inventors: Noriaki Okazawa, Nagano (JP); Nobuhiko Yamauchi, Nagano (JP); Sumio Arai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 410 days.

(21) Appl. No.: 11/357,187

(22) Filed: Feb. 21, 2006

(65) Prior Publication Data

US 2006/0201908 A1 Sep. 14, 2006

(30) Foreign Application Priority Data

Feb. 21, 2005 (JP) ..... P2005-043529

(51) Int. Cl.
*B41J 2/04* (2006.01)

(52) U.S. Cl. ..... 347/54

(58) Field of Classification Search ..... 347/40, 347/54, 65; 216/68, 17, 27
See application file for complete search history.

(56) References Cited

U.S. PATENT DOCUMENTS 5,455,615 A * 10/1995 Burr et al. ..... 347/92
5,757,400 A * 5/1998 Hoisington ..... 347/40
6,406,133 B1 * 6/2002 Abe ..... 347/55
6,523,942 B2 * 2/2003 Sakamoto et al. ..... 347/68
6,685,305 B2 * 2/2004 Okuda ..... 347/71
6,793,324 B2 * 9/2004 Hosono et al. ..... 347/54
7,284,835 B2 * 10/2007 Watanabe ..... 347/54

FOREIGN PATENT DOCUMENTS

JP 2000-62164 A 2/2000
JP 2004-50716 A 2/2004
JP 2004-216747 A 8/2004

* cited by examiner

*Primary Examiner*—Anh T. N. Vo
(74) *Attorney, Agent, or Firm*—Sughrue Mion, PLLC

(57) ABSTRACT

A method of producing a liquid ejection head comprising: a flow path forming substrate in which a space including pressure generating chambers and an ink reserving chamber is formed; a nozzle plate which is stacked on one face of the flow path forming substrate; and a vibration plate which is stacked on the other face of the flow path forming substrate is provided. The flow path forming substrate is formed by a monocrystal silicon substrate in which a plane of crystal plane orientation of (110) is the surface. When the ink reserving chamber penetrating from the one face of the substrate to the other face is formed by anisotropically etching the (110) plane of the flow path forming substrate, a (111) plane which is inclined with respect to the (110) plane is caused to appear, whereby a step portion which extends in the plate face direction of the substrate, and in which an inner wall face of the flow path forming substrate on the side of the nozzle plate is inward projected is formed on an inner wall face of the ink reserving chamber.

14 Claims, 11 Drawing Sheets

ENLARGED VIEW OF PORTION K

ENLARGED VIEW OF PORTION L

ENLARGED VIEW OF PORTION K

ENLARGED VIEW OF PORTION L

LIQUID EJECTION HEAD AND METHOD OF PRODUCING SAME

BACKGROUND OF THE INVENTION

1. Technical Field of the Invention

The present invention relates to a liquid ejection head which ejects liquid supplied from a liquid cartridge or the like, as liquid droplets, and more particularly to a liquid ejection head in which a flow path forming substrate constituting a flow path unit can be prevented from being broken, and a method of producing same.

2. Description of the Related Art

An ink-jet recording apparatus which is a typical example of a liquid ejection apparatus has a configuration in which an ink-jet recording head (liquid ejection head) having: pressure generating means for pressurizing a pressure generating chamber; and a nozzle opening from which a pressurized ink is ejected as an ink droplet is mounted on a carriage.

In a multi-nozzle ink-jet recording head in which plural nozzle openings are arranged in one substrate, a nozzle plate in which plural nozzle openings are opened, a flow path forming substrate in which a space serving as pressure generating chambers and ink supply flow paths is formed, and a vibration plate which seals another face are stacked and joined together. A pressure is generated in the pressure generating chambers by deformation stress of the vibration plate caused by a piezoelectric vibrator, thereby ejecting ink droplets from the nozzle openings (for example, JP-A-2000-62164).

FIGS. 8 and 9 show a flow path forming substrate 50 in a related art recording head. The flow path forming substrate 50 comprises pressure generating chambers 51 which are disposed in a row, and ink reserving chambers 53 which are disposed along the row of the pressure generating chambers 51, and which reserves an ink to be supplied to the pressure generating chambers 51 through ink supply paths 52. In this example, two rows of pressure generating chambers 51 are formed, and a total of two ink reserving chambers 53 are disposed so as to respectively correspond to the rows of the pressure generating chambers 51.

In the flow path forming substrate 50, a space corresponding to the pressure generating chambers 51, the ink supply paths 52, and the ink reserving chambers 53 is formed by anisotropically etching a monocrystal silicon substrate, and each of the ink reserving chambers 53 is formed as a space which vertically penetrates from one face of the substrate to the other face.

In the recording head, an end portion (the portion K in FIG. 8, and the portion L in FIG. 9) of each of the ink reserving chambers 53 in the row direction of the pressure generating chambers 51 is narrowed so that the width of the ink reserving chamber 53 is tapered, thereby improving the property of discharging air bubbles staying in the end portion of the ink reserving chamber 53 (see JP-A-2000-62164).

As shown in FIG. 10, in the end portion (the portion K in FIG. 8, and the portion L in FIG. 9) of each of the ink reserving chambers 53 in the row direction of the pressure generating chambers 51 in the flow path forming substrate 50, a projection 54 having a triangular section shape is formed in the vicinity of a middle area in the thickness direction of the width-tapered portion of the ink reserving chamber 53. The projection 54 is formed in the process of forming the ink reserving chamber 53 by anisotropic etching of the monocrystal silicon substrate.

FIG. 11 is a view showing steps of producing the conventional flow path forming substrate 50. First, a monocrystal silicon substrate 55 which is cut out so that a plane of crystal plane orientation of (110) is the surface is prepared. A pattern of a silicon oxide film 56 is formed on the both faces of the silicon substrate 55 by photo-etching using a resin resist (FIG. 11A). In the illustrated state, as a result of the patterning, an etching region 57 where the silicon oxide film 56 does not exist is formed in portions which will be formed as the ink reserving chambers 53, on the upper and lower faces of the silicon substrate 55.

Then, anisotropic etching is performed with using an etching solution such as an aqueous solution of potassium hydroxide, to etch the surfaces of the etching regions 57 on the both or upper and lower faces of the monocrystal silicon substrate 55. At this time, the etching advances while a (111) plane which is inclined by about 35 deg. with respect to the (110) plane appears (FIG. 11B). In a state where the etching portions on the upper and lower faces communicate with each other to achieve penetration, the (111) plane appearing from the upper faces meets that appearing from the lower faces, and a ridge edge is formed by the two (111) planes (FIG. 11C).

When the upper and lower (111) planes meet together to form the ridge, the etching advances while a (111) plane perpendicular to the (110) plane appears in end portions of the silicon oxide film 56, i.e., boundary portions between the region masked by the silicon oxide film 56 and the etching regions where the silicon oxide film 56 does not exist (FIG. 11D). As a result of such etching behavior, the projections 54 having a triangular section shape are finally formed on end portions in the row direction of the pressure generating chambers 51 of the ink reserving chamber 53.

When such projections 54 are formed in the flow path forming substrate 50, however, stress concentration easily occurs in a portion where the ridge portion of each of the projections 54 is in contact with the wall face. When the projection 54 exists in the tapered end portion of the ink reserving chamber 53, particularly, stress is further concentrated in the portion. Consequently, there is a problem in that, when stress concentration occurs in the portion, the flow path forming substrate 50 cracks in handling in production steps and becomes a defective product, thereby lowering the production yield. When the projection 54 exists on the inner wall face of the ink reserving chamber 53, the ink flow is blocked by the projection 54. Consequently, there is another problem in that the air bubble discharging property in the case where air bubbles staying in the ink reserving chamber 53 are forcibly sucked to be discharged through the nozzle openings is impaired. Particularly, the vicinity of the nozzle row end of the ink reserving chamber 53 is a place where the air bubble discharging property easily becomes problematic. The existence of the projection 54 in such a place imposes a large adverse affect on the air bubble discharging property.

SUMMARY OF THE INVENTION

The invention has been conducted in view of such circumstances. It is an object of the invention to provide a liquid ejection head in which a flow path forming substrate constituting a flow path unit is prevented from being broken, and a method of producing it.

In order to attain the object, in a liquid ejection head according to one embodiment of the invention, the liquid ejection head comprises: a flow path forming substrate in which a space is formed, the space including pressure generating chambers which are disposed in a row, and a liquid reserving chamber which reserves liquid to be supplied to the pressure generating chambers; a nozzle plate which is stacked on one face of the flow path forming substrate, and in which nozzle openings for ejecting the liquid in the pressure generating chambers are disposed in a row; and a sealing plate which is stacked on another-face of the flow path forming substrate to seal the space, the flow path forming substrate is formed by a monocrystal silicon substrate, the liquid reserving chamber is formed as a space which penetrates from the one face of the substrate to the other face, and a step portion which extends in a plate face direction of the substrate is formed on an inner wall face of the liquid reserving chamber.

In order to attain the object, a method of producing a liquid ejection head according to one embodiment of the invention comprises: a flow path forming substrate in which a space is formed, the space including pressure generating chambers which are disposed in a row, and a liquid reserving chamber which reserves liquid to be supplied to the pressure generating chambers; a nozzle plate which is stacked on one face of the flow path forming substrate, and in which nozzle openings for ejecting the liquid in the pressure generating chambers are disposed in a row; and a sealing plate which is stacked on another face of the flow path forming substrate to seal the space, wherein the flow path forming substrate is formed by a monocrystal silicon substrate in which a plane of crystal plane orientation of (110) is a surface, and, when the liquid reserving chamber penetrating from the one face of the substrate to another face is formed by anisotropically etching the (110) plane, a step portion which extends in a plate face direction of the substrate is formed on an inner wall face of the liquid reserving chamber.

In the liquid ejection head of the invention, it is preferably that the flow path forming substrate is formed by a monocrystal silicon substrate, the liquid reserving chamber is formed as a space which penetrates from the one face of the substrate to the other face, and a step portion which extends in the plate face direction of the substrate is formed on the inner wall face of the liquid reserving chamber. The step portion which extends in the plate face direction of the substrate is formed on the inner wall face of the liquid reserving chamber to relax stress concentration in the inner wall portion of the liquid reserving chamber, whereby the flow path forming substrate is prevented from being broken in handling in production steps or the like, so that the production yield is improved. Unlike the related art, a projection is not formed, but the step portion is formed. Therefore, the liquid flow is smoothened, and the air bubble discharging property in forced suction is improved.

In the liquid ejection head of the invention, it is preferably that the flow path forming substrate is formed by a monocrystal silicon substrate in which a plane of crystal plane orientation of (110) is a surface, and the step portion is formed by appearance of a (111) plane which is inclined with respect to the (110) plane. In this case, the step portion can be easily formed by anisotropic etching of the monocrystal silicon substrate, or the like, and the step portion is formed as an inclined face. Therefore, a corner formed by the step portion and the inner wall face is increased, and the effect of relaxing stress concentration is enhanced.

In the liquid ejection head of the invention, it is preferably that the step portion is formed by an inclined plane which is downward inclined toward the nozzle plate. In this case, a downward inclined face along the flow of the liquid is obtained. Therefore, the liquid flow is smoothened flows, and the air bubble discharging property in forced suction is improved.

In the liquid ejection head of the invention, it is preferably that the step portion is a step in which an inner wall face of the flow path forming substrate on a side of the nozzle plate is inward projected. In this case, the formation of the step portion by anisotropically etching the both faces of the monocrystal silicon substrate is conducted in a relatively easy manner. Furthermore, the liquid flow is smoothened, and the air bubble discharging property in forced suction is improved.

In the liquid ejection head of the invention, it is preferably that the step portion is formed in an end portion of the liquid reserving chamber in a direction of a nozzle row. In this case, the end portion is a place where breakage due to stress concentration easily occurs, and hence a high effect that breakage of the flow path forming substrate is prevented from occurring by relaxing stress concentration in the portion is attained. Since the end portion is a place where the air bubble discharging property easily becomes problematic, the effect that the liquid flow is smoothened and the air bubble discharging property in forced suction is improved is remarkably produced.

In the liquid ejection head of the invention, it is preferably that the step portion is formed in a farthest end portion which is formed by tapering an end region of the liquid reserving chamber in the direction of nozzle row. In this case, the farthest portion is a place where breakage due to stress concentration easily occurs, and hence a high effect that breakage of the flow path forming substrate is prevented from occurring by relaxing stress concentration in the portion is attained. Since the farthest portion is a place where the air bubble discharging property easily becomes problematic, the effect that the liquid flow is smoothened and the air bubble discharging property in forced suction is improved is remarkably produced.

In the liquid ejection head of the invention, in the liquid reserving chamber, it is preferably that the inner wall face is formed by appearance of two (111) planes perpendicular to a plane of crystal plane orientation of (110), and the step portion is formed in a boundary portion between a straight plane in which one of the two (111) planes perpendicular to the plane of crystal plane orientation of (110) appears straight, and a step plane in which the two (111) planes perpendicular to the plane of crystal plane orientation of (110) appear in a step-like manner. In this case, in the boundary portion between the straight plane and the step plane, cracks are easily formed along the (111) plane of the straight plane. Therefore, a high effect that breakage of the flow path forming substrate is prevented from occurring by relaxing stress concentration in the portion is attained.

In the method of producing a liquid ejection head of the invention, it is preferably that the flow path forming substrate is formed by a monocrystal silicon substrate in which a plane of crystal plane orientation of (110) is a surface, and, when the liquid reserving chamber penetrating from the one face of the substrate to another face is formed by anisotropically etching the (110) plane, a step portion which extends in a plate face direction of the substrate is formed on an inner wall face of the liquid reserving chamber. The step portion which extends in the plate face direction of the substrate is formed by anisotropic etching on the inner wall face of the liquid reserving chamber to relax stress concentration in the inner wall portion of the liquid reserving chamber, whereby the flow path forming substrate is prevented from being broken in handling in production steps or the like, so that the production yield is improved. Unlike the conventional art, a projection is not formed, but the step portion is formed. In an obtained liquid ejection head, therefore, the liquid flow is smoothened, and the air bubble discharging property in forced suction is improved.

In the method of producing a liquid ejection head of the invention, it is preferably that the step portion is formed by appearance of a (111) plane which is inclined with respect to the (110) plane. In this case, the step portion can be easily formed by anisotropic etching of the monocrystal silicon substrate, and the step portion is formed as an inclined face. Therefore, a corner formed by the step portion and the inner wall face is increased, and the effect of relaxing stress concentration is enhanced.

In the method of producing a liquid ejection head of the invention, it is preferably that when a pattern of an etching protective film is formed on sides of the one and other faces of the flow path forming substrate and the liquid reserving chamber is formed by anisotropic etching of etching regions of the faces, the step portion is formed by performing the anisotropic etching in a state where a boundary between the etching protective film and the etching region on the side of the one face is shifted from a boundary between the etching protective film and the etching region on the side of the other face. In this case, the formation of the step portion by anisotropically etching the both faces of the monocrystal silicon substrate is conducted in a relatively easy manner.

In the method of producing a liquid ejection head of the invention, it is preferably that a boundary between an etching protective film and an etching region on a face on a side of the nozzle plate is placed to be shifted with respect to a boundary between an etching protective film and an etching region on a face on a side of a vibration plate, toward a region which is to be formed as the liquid reserving chamber, thereby forming the step portion as a step in which an inner wall face of the flow path forming substrate on the side of the nozzle plate is inward projected. In this case, the formation of the step portion by anisotropically etching the both faces of the monocrystal silicon substrate is conducted in a relatively easy manner.

In the method of producing a liquid ejection head of the invention, it is preferably that the step portion is formed in an end portion of the liquid reserving chamber in a direction of a nozzle row. In this case, the end portion is a place where breakage due to stress concentration easily occurs, and hence a high effect that breakage of the flow path forming substrate is prevented from occurring by relaxing stress concentration in the portion is attained. Since the end portion is a place where the air bubble discharging property easily becomes problematic, the effect that the liquid flow is smoothened and the air bubble discharging property in forced suction is improved is remarkably produced.

In the method of producing a liquid ejection head of the invention, it is preferably that the step portion is formed in a farthest end portion which is formed by tapering an end region of the liquid reserving chamber in the direction of a nozzle row. In this case, the farthest portion is a place where breakage due to stress concentration easily occurs, and hence a high effect that breakage of the flow path forming substrate is prevented from occurring by relaxing stress concentration in the portion is attained. Since the farthest portion is a place where the air bubble discharging property easily becomes problematic, the effect that the liquid flow is smoothened and the air bubble discharging property in forced suction is improved is remarkably produced.

In the method of producing a liquid ejection head of the invention, in the liquid reserving chamber, it is preferably that the inner wall face is formed by appearance of two (111) planes perpendicular to the plane of crystal plane orientation of (110), and the step portion is formed in a boundary portion between a straight plane in which one of the two (111) planes perpendicular to the plane of crystal plane orientation of (110) appears straight, and a step plane in which the two (111) planes perpendicular to the plane of crystal plane orientation of (110) appear in a step-like manner. In this case, in the boundary portion between the straight plane and the step plane, cracks are easily formed along the (111) plane of the straight plane. Therefore, a high effect that breakage of the flow path forming substrate is prevented from occurring by relaxing stress concentration in the portion is attained.

DETAILED DESCRIPTION OF THE INVENTION

Next, embodiments of the invention will be described in detail.

Figure 1:
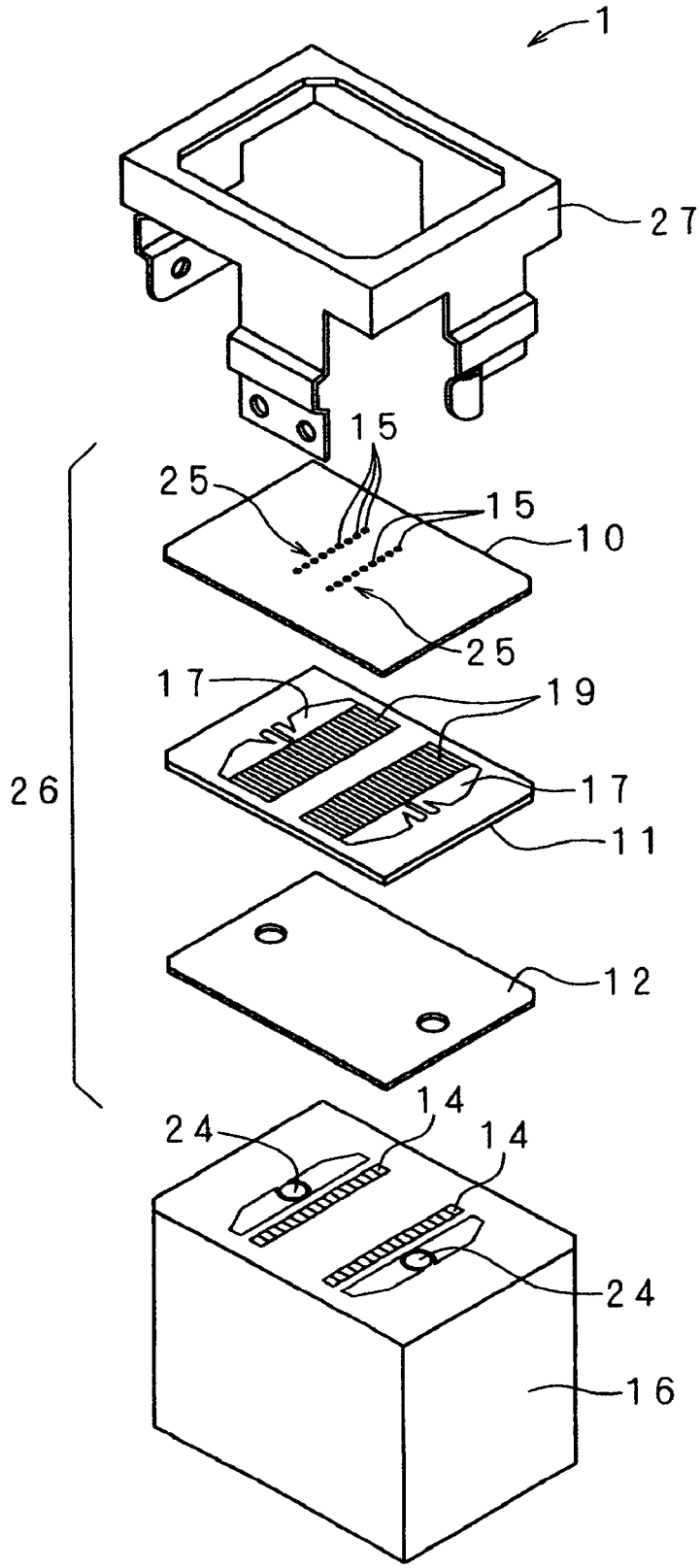
FIG. 1 is an exploded perspective view showing an example of a recording head to which the invention is applied.
Figure 2:
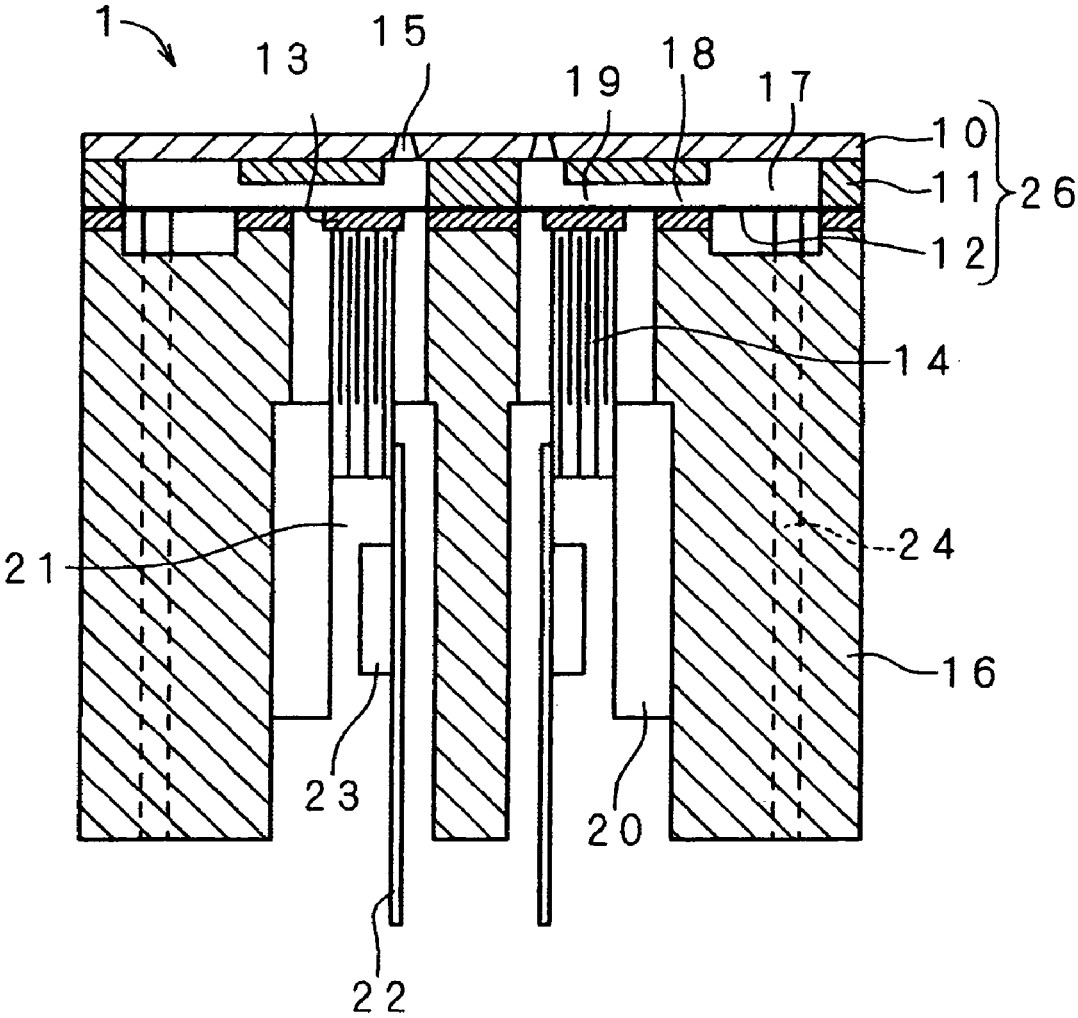
FIG. 2 is a section view showing the recording head.

FIGS. 1 and 2 are views showing an example of the structure of an ink-jet recording head 1 to which the liquid ejection head of the invention is applied. The recording head 1 comprises; a head case 16 which houses piezoelectric vibrators 14 serving as pressure generating means; and a flow path unit 26 which is fixed to a unit fixing face of the head case 16 by an adhesive agent.

The flow path unit 26 is configured by stacking: a flow path forming substrate 11 in which a flow path space is formed, the flow space including pressure generating chambers 19 which are disposed in a row, and ink reserving chambers 17 which reserve an ink to be supplied to the pressure generating chambers 19; a nozzle plate 10 which is stacked on one face of the flow path forming substrate 11, and in which nozzle openings 15 for ejecting the ink in the pressure generating chambers 19 are formed; and a vibration plate (sealing plate) 12 which is stacked on the other face of the flow path forming substrate 11, and which seals the flow path space including the pressure generating chambers 19.

In the nozzle plate 10, nozzle openings 15 are disposed in plural rows to form nozzle rows 25. In the embodiment, two nozzle rows 25 are formed, and configured so as to eject inks of different kinds. The nozzle plate 10 is formed by a stainless steel plate.

In the flow path forming substrate 11, the pressure generating chambers 19 which communicate respectively with the nozzle openings 15 are disposed in a row. The common ink reserving chambers 17 which reserve the inks to be supplied to the pressure generating chambers 19 through ink supply paths 18 are formed so as to be-placed along the respective rows of the pressure generating chambers 19.

The nozzle rows 25 are disposed in the direction perpendicular to the plane of the sheet of FIG. 2. In the embodiment, the two nozzle rows 25 are disposed, and two rows of the pressure generating chambers 19 are disposed so as to correspond to the nozzle rows 25, respectively. One pressure generating chamber 19 is disposed correspondingly with each of the rows of the pressure generating chambers 19. The flow path forming substrate 11 is formed by etching a single crystal Si substrate.

The vibration plate 12 is made of a polyphenylene sulfide film, and formed by laminating lands 13 made of a stainless steel plate, etc.

The nozzle plate 10 is staked on one face of the flow path forming substrate 11, and the vibration plate 12 is stacked on the other face so that the lands 13 are placed outside, thereby constituting the flow path unit 26. An adhesive agent is applied to the flow path forming substrate 11, the nozzle plate 10, and the vibration plate 12, and the components are heated and held at a predetermined high temperature to be joined together, and thereafter cooled to room temperature, thereby forming the flow path unit 26.

By contrast, the head case 16 is formed by injection molding of a thermosetting resin or a thermoplastic resin, and configured so that the piezoelectric vibrators 14 are housed in housing spaces 21 vertically penetrating, so as to correspond respectively to the pressure generating chambers 19. The housing spaces 21 elongate in the direction of the nozzle rows 25, and two housing spaces are disposed correspondingly with the nozzle rows 25. The piezoelectric vibrators 14 are piezoelectric vibrators of the longitudinal vibration mode, and fixed to fixing plates 20 in the rear end side.

In a state where the side of the vibration plate 12 in the flow path unit 26 is joined to the unit fixing face of the head case 16 by the adhesive agent, tip end faces of the piezoelectric vibrators 14 are fixed to the lands 13 of the vibration plate 12, and the fixing plates 20 are bonded and fixed to the head case 16, thereby constituting the recording head 1.

In the thus configured recording head 1, a driving signal generated by a driving circuit 23 is supplied to the corresponding one of the piezoelectric vibrators 14 via a flexible circuit board 22, whereby the piezoelectric vibrator 14 is expanded and contracted in the longitudinal direction. The expansion and contraction of the piezoelectric vibrator 14 cause the land 13 of the vibration plate 12 to vibrate, and the pressure in the pressure generating chamber 19 is changed, whereby the ink in the pressure generating chamber 19 is ejected as an ink droplet from the nozzle opening 15. In the figures, 24 denotes an ink flow path for supplying the ink to the ink reserving chamber 17, and 27 denotes a head cover.

The recording head 1 is mounted on a carriage which is reciprocally moved in the width direction of a recording sheet, and ejects ink droplets onto the recording sheet while moving the carriage, to print an image or characters on the recording sheet by means of dot matrix.

Figure 3:
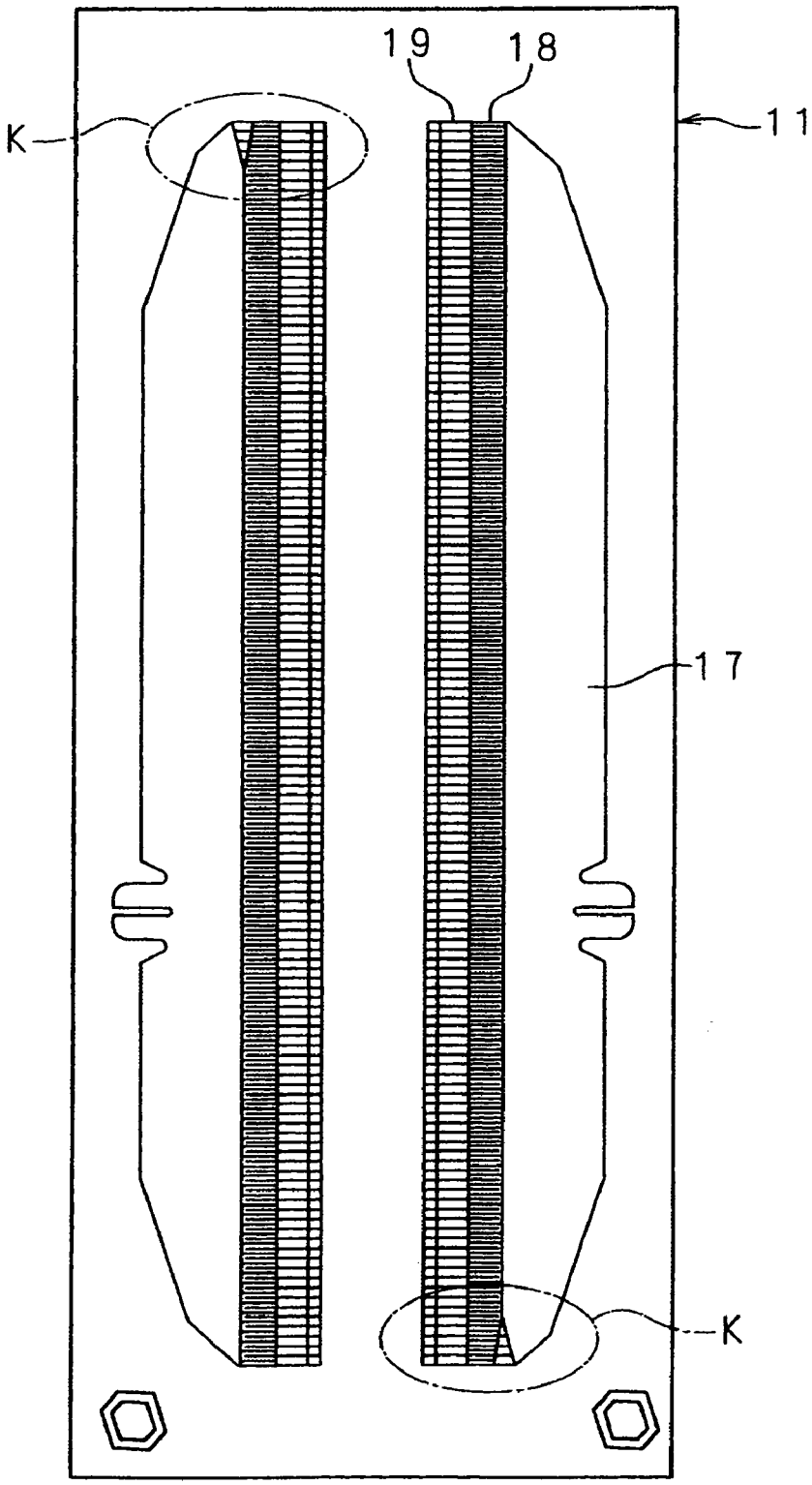
FIG. 3 is a plan view showing a flow path forming substrate.
Figure 4:
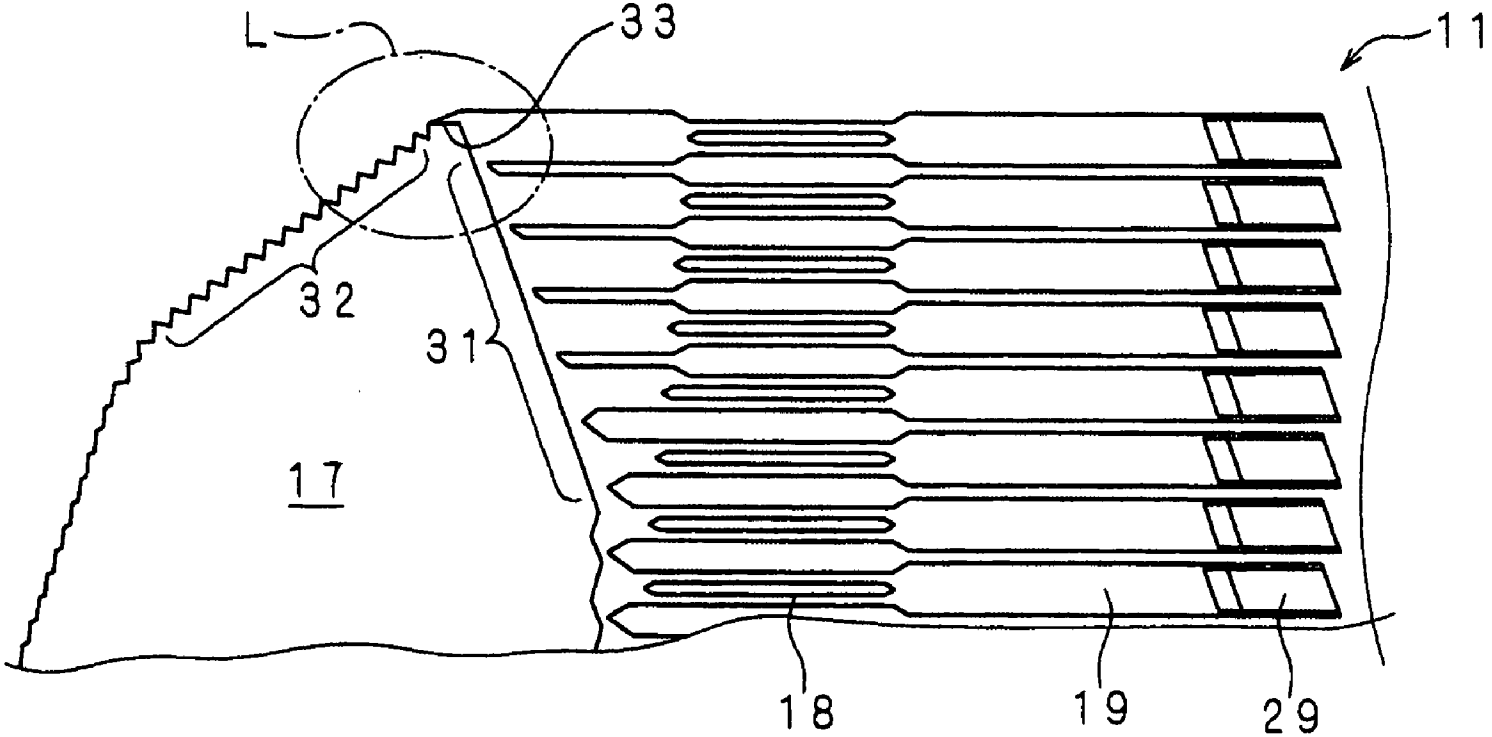
FIG. 4 is a plan view showing a main portion of the flow path forming substrate.
Figure 5A:
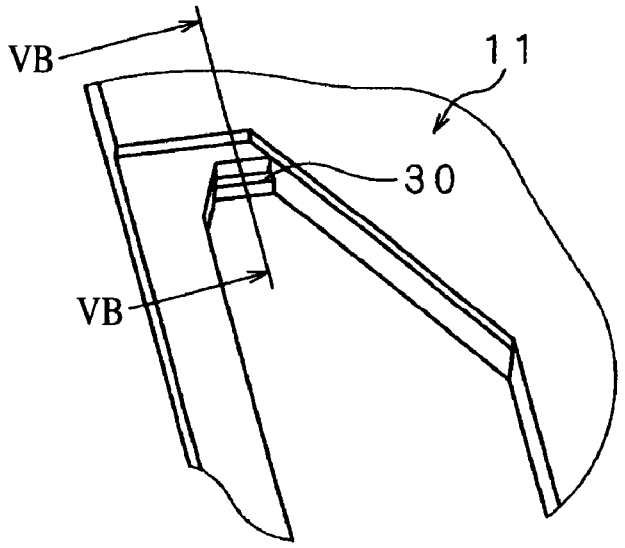
FIG. 5A is a perspective view showing a main portion of the flow path forming substrate and FIG. 5B is a section view taken along the line VB-VB in FIG. 5A.

FIGS. 3 to 5 are views showing the flow path forming substrate 11. FIG. 3 is a plan view showing the whole flow path forming substrate 11, FIG. 4 is a plan view showing a main portion (the portion K in FIG. 3) of the substrate, and FIG. 5 is a perspective view and a section view further showing a main portion (the portion L in FIG. 4).

In the flow path forming substrate 11, the pressure generating chambers 19 are disposed in a row in correspondence with the nozzle openings 15 constituting the nozzle rows 25, and each of the ink reserving chambers 17 which extend in the direction of the nozzle rows 25 is disposed along the row of the pressure generating chambers 19. The ink reserving chamber 17 communicates with the pressure generating chambers 19 through the ink supply paths 18.

The flow path forming substrate 11 is formed by anisotropically etching a monocrystal silicon substrate 40 (see FIG. 6). A space which will be formed as the ink reserving chamber 17 is formed as a space which vertically penetrates from one face (on the side of the nozzle plate 10) of the flow path forming substrate 11 to the other face (on the side of the vibration plate 12). In the embodiment, the pressure generating chambers 19 and the ink supply paths 18 are formed as grooves in the face of the flow path forming substrate 11 on the side of the vibration plate 12. In tip end portions of the pressure generating chambers 19, formed are communication ports 29 through which the pressure generating chambers 19 communicate with the respective nozzle openings 15.

As shown in FIG. 5, in the flow path forming substrate 11, a step portion 30 which extends in the plate face direction of the substrate is formed on the inner wall face of the ink reserving chamber 17. The step portion 30 is formed in an end portion of the ink reserving chamber 17 in the direction of the nozzle row 25, and in the farthest portion 33 which is formed by tapering an end region of the ink reserving chamber 17.

The monocrystal silicon substrate 40 constituting the flow path forming substrate 11 is cut out so that a plane of crystal plane orientation of (110) is the surface. That is, both the one face to which the nozzle plate 10 is joined, and the other face to which the vibration plate 12 is joined are faces in which a plane of crystal plane orientation of (110) appears on the surface.

As described later in detail, the pressure generating chambers 19, the ink supply paths 18, and the ink-reserving chambers 17 of the flow path forming substrate 11 are formed by producing spaces by means of anisotropic etching of the monocrystal silicon substrate 40. When each of the spaces is formed by anisotropically etching the monocrystal silicon substrate 40 in which a plane of crystal plane orientation of (110) appears on the surface, two (111) planes perpendicular to the (110) plane appear as an inner wall face.

In each of the ink reserving chambers 17, therefore, the inner wall face is formed by appearance of the two (111) planes perpendicular to the plane of crystal plane orientation of (110). The two (111) planes form a constant angle of about 70 deg. (or 110 deg.). When the inner wall face is parallel to the (110) plane, therefore, the inner wall face is a straight plane in which the (110) plane appears straight. A plane in which the inner wall face is not parallel to the (110) plane becomes a step plane in which two (110) planes appear in a step-like manner, when a correction pattern is formed and an etching process is performed with using the pattern.

By contrast, end regions of the ink reserving chamber 17 are formed into a shape which is narrowed in a tapered manner with respect to the width of the ink reserving chamber 17, in order to improve the property of discharging air bubbles staying in the end regions. According to the configuration, when forced suction is conducted by applying a negative pressure on the nozzle openings 15, the negative pressure applied to the ink supply paths 18 is readily directly applied to the end regions. As a result, air bubbles staying in the end regions are easily discharged.

As described above, the end regions of the ink reserving chamber 17 are formed into a shape which is narrowed in a tapered manner with respect to the width of the ink reserving chamber 17, and, in one of the two end regions, a tapered shape is formed by a straight plane 31 in which one of the two (111) planes perpendicular to the plane of crystal plane orientation of (110) appears straight, and a step plane 32 in which the two (111) planes perpendicular to the plane of crystal plane orientation of (110) appear in a step-like manner (the portion K in FIG. 3, and FIG. 4). The tapered portions each of which is formed by the straight plane 31 and the step plane 32 are diagonally placed in the two ink reserving chambers 17 which are disposed across the opposing pressure generating chambers 19 (see FIG. 3).

The step portion 30 is formed in the tapered portion formed by the straight plane 31 and the step plane 32, and in the farthest portion 33 of the ink reserving chamber 17 corresponding to the boundary portion between the straight plane 31 and the step plane 32 (see FIG. 4).

Figure 5B:
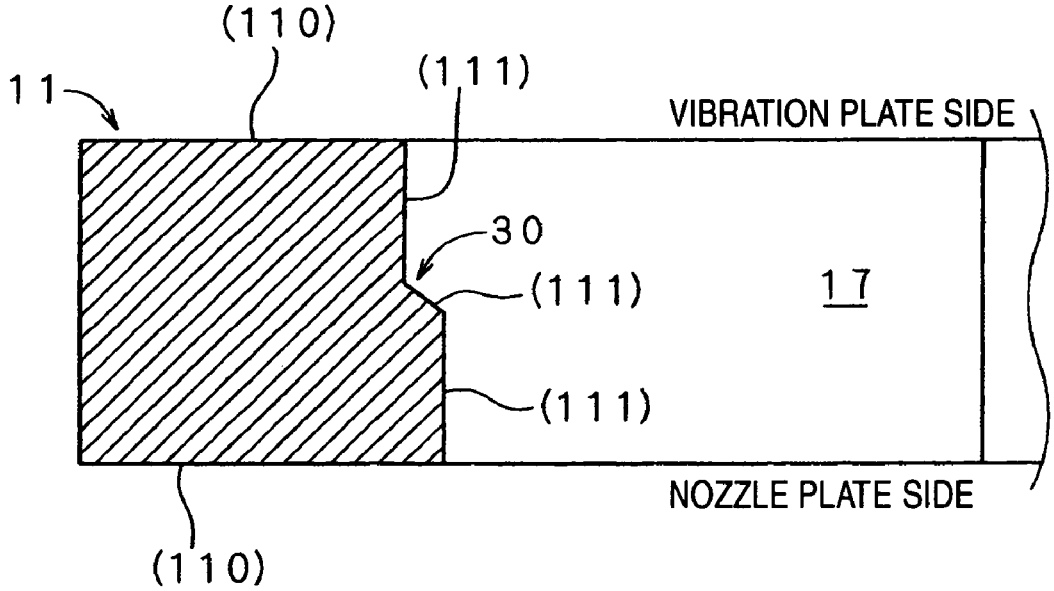

As shown in FIG. 5B, the step portion 30 is formed in a position corresponding to about one half of the thickness of the flow path forming substrate 11, and on the inner wall face of the ink reserving chamber 17 which is formed by appearance of the (111) planes perpendicular to the plane of crystal plane orientation of (110). Also an inner wall face which is on the side of the vibration plate 12 with respect to the step portion 30, and that which is on the side of the nozzle plate 10 with respect to the step portion 30 are formed by appearance of the (111) plane perpendicular to the plane of crystal plane orientation of (110). The step portion 30 is formed by appearance of the (111) plane which is inclined by an angle of about 35 deg. with respect to the plane of crystal plane orientation of (110), and as an inclined face which is downward inclined toward the nozzle plate 10. The step portion 30 is a step in which an inner wall face of the flow path forming substrate 11 on the side of the nozzle plate 10 is inward projected.

Next, a method of producing the recording head 1 of the invention will be described.

FIGS. 6 and 7 are views illustrating an example of steps of producing the thus configured flow path forming substrate 11 which is to be applied to the recording head 1 of the invention.

Figure 6A:
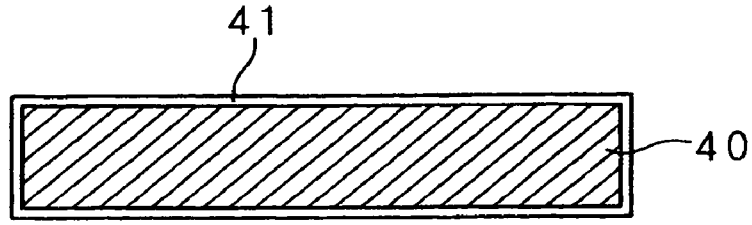
FIGS. 6A to 6D are production step diagrams illustrating the production method of the invention.

As shown in FIG. 6A, first, the monocrystal silicon substrate 40 is prepared. The monocrystal silicon substrate 40 is cut out so that the substrate has a predetermined thickness (for example, 220 μm) required for functioning as the flow path forming substrate 11, and the surface and the rear face have the crystal orientation (110). In the monocrystal silicon substrate 40, an etching protective film 41 against an anisotropic etching solution is formed by, for example, a silicon dioxide film which is formed by the thermal oxidation method to have a thickness of about 1 μm.

Figure 6B:
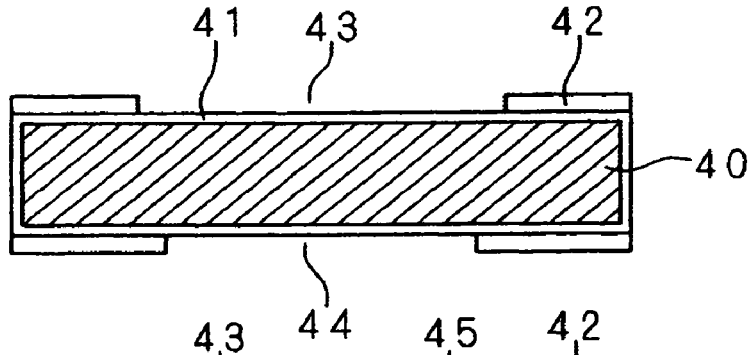

As shown in FIG. 6B, a photocurable photosensitive layer is formed on the surface and rear face of the monocrystal silicon substrate 40 on which the etching protective film 41 is formed. Patterns which correspond to the ink reserving chambers 17 and the communication ports 29 that are penetrating portions, and the pressure generating chambers 19 and the ink supply paths 18 that are recesses, and which have a mirror image relationship are positioned on the surface and rear face, and then an exposing process is performed. Thereafter, the substrate is immersed in photolithography chemicals. The photosensitive layer in exposed region, i.e., the regions where the ink reserving chambers 17 and the like are to be formed is selectively dissolved, and a hardened resist layer 42 and windows 43, 44 from which the photosensitive layer is removed away are formed.

At this time, in areas where the step portions 30 are to be formed, the positions of the boundary portions between the resist layer 42 and the windows 43 and 44 are shifted from each other on the faces which are to be respectively on the side of the vibration plate 12 and on the side of the nozzle plate 10. That is, the shifting is performed so that the boundary portion between the resist layer 42 and the window 44 on the face on the side of the nozzle plate 10 is positioned closer to the regions to be formed as the ink reserving chambers 17 (the inner side in the figure) than the boundary portion between the resist layer 42 and the window 43 on the face on the side of the vibration plate 12.

Figure 6C:
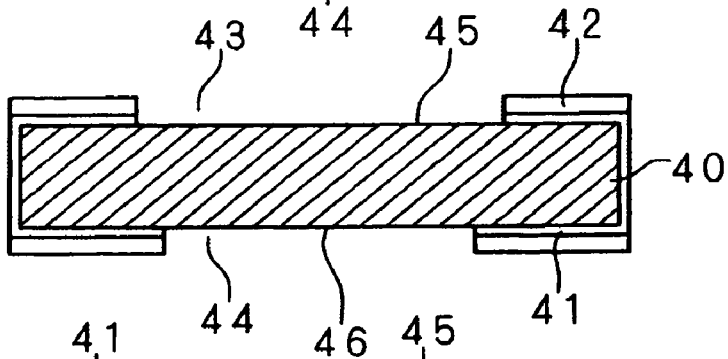

As shown in FIG. 6C, when an etching process is performed in this state with using a hydrogen fluoride solution, the etching protective film 41 exposed from the windows 43, 44 where the ink reserving chambers 17 and the like are to be formed is etched away, with the result that the monocrystal silicon of etching regions 45, 46 which will be anisotropically etched to form the ink reserving chambers 17 and the like are exposed.

Figure 6D:
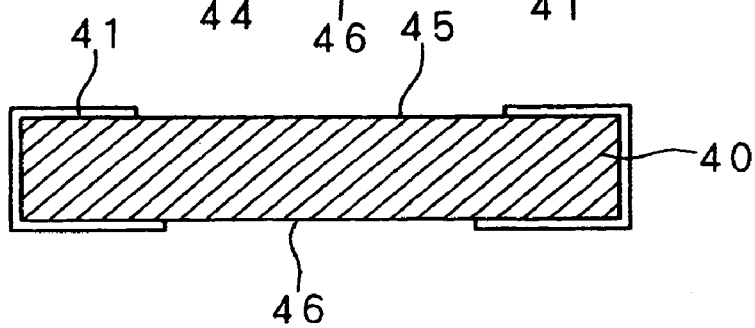

As shown in FIG. 6D, thereafter, the remaining resist layer 42 is removed away, and the pattern of the etching protective film 41 and the etching regions 45, 46 from which the etching protective film 41 is removed away are formed. In areas where the step portions 30 are to be formed, the positions of the boundary portions between the etching protective film 41 and the etching regions 45 and 46 are shifted from each other on the faces which are to be respectively on the side of the vibration plate 12 and on the side of the nozzle plate 10. That is, the shifting is performed so that the boundary portion between the etching protective film 41 and the etching region 46 on the face on the side of the nozzle plate 10 is positioned closer to the etching regions 45, 46 to be formed as the ink reserving chambers 17 (the inner side in the figure) than the boundary portion between the etching protective film 41 and the etching region 45 on the face on the side of the vibration plate 12.

Next, anisotropic etching is performed on the monocrystal silicon substrate 40 on which the pattern of the etching protective film 41 is formed.

Figure 7A:
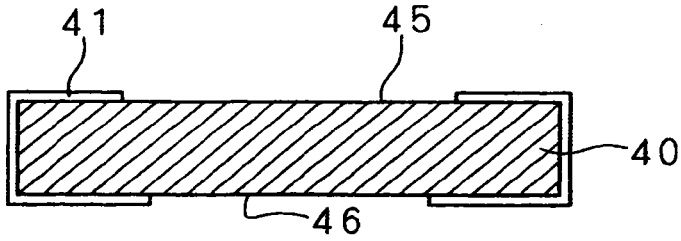
FIGS. 7A to 7E are production step diagrams illustrating the production method of the invention.

As shown in FIG. 7A, first, the monocrystal silicon substrate 40 on which the pattern of the etching protective film 41 is formed is prepared. An etching process is performed with using an etching solution such as an aqueous solution of potassium hydroxide which is maintained to a constant temperature (for example, 80° C.), and which has a concentration of about 17%. Then, only the portions of the etching regions 45, 46 where the etching protective film 41 does not exist are etched away.

Figure 7B:
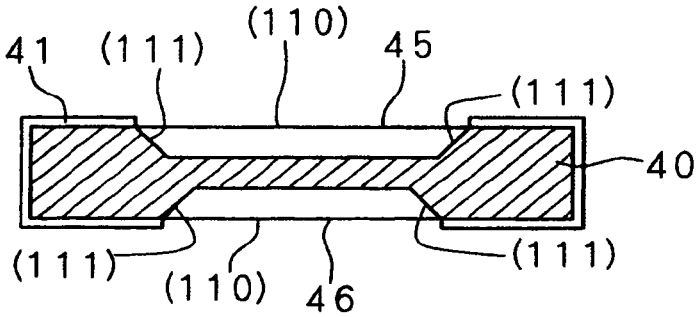

As shown in FIG. 7B, in the etching process, the etching advances on the both faces at a rate of about 2 μm per minute. At this time, the etching advances in the depth direction in parallel with a plane of crystal plane orientation of (110) while a plane of crystal plane orientation of (111) which forms an angle of about 35 deg. with respect to the surface and rear face of the (110) plane appears.

Figure 7C:
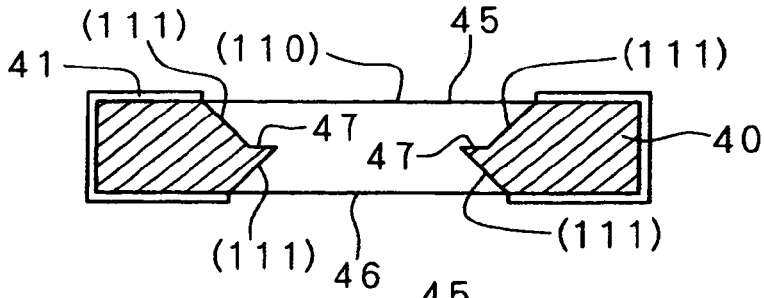

As shown in FIG. 7C, when the etching further advances, the etching portions of the surface and the rear face communicate with each other, and a penetrating portion is formed. The (111) plane which has appeared in the previous etching, and which is the 35 deg. inclined face reaches the boundary portions between the etching protective film 41 and the etching regions 45, 46. At this time, since the boundary portion between the etching protective film 41 and the etching region 46 on the face on the side of the nozzle plate 10 is positioned closer to the etching regions 45, 46 to be formed as the ink reserving chambers 17 than the boundary portion between the etching protective film 41 and the etching region 45 on the face on the side of the vibration plate 12, projections 47 in which a plane parallel to the (110) plane remains at a degree corresponding to the shifting amount are formed.

Figure 7D:
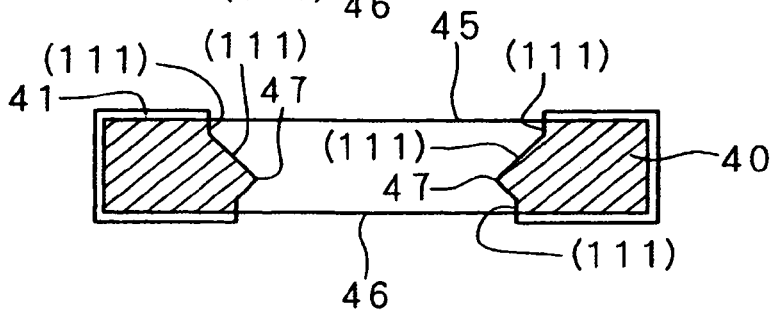

As shown in FIG. 7D, when the etching further advances, the etching advances while two (111) planes perpendicular to the (110) plane serving as the surface and the rear face appear, in the boundary portions between the etching protective film 41 and the etching regions 45, 46. At this time, in accordance with the advancement of the etching process, the projections 47 are gradually reduced in size by the etching.

Figure 7E:
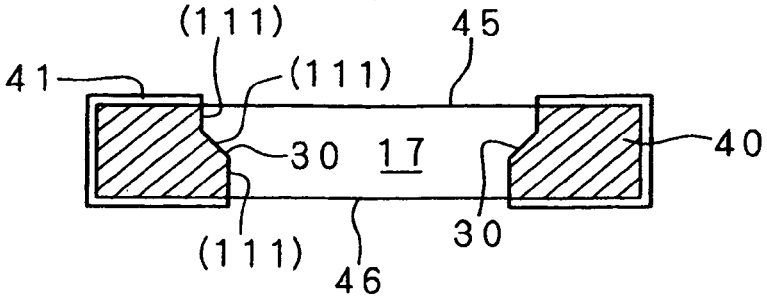
Figure 8:
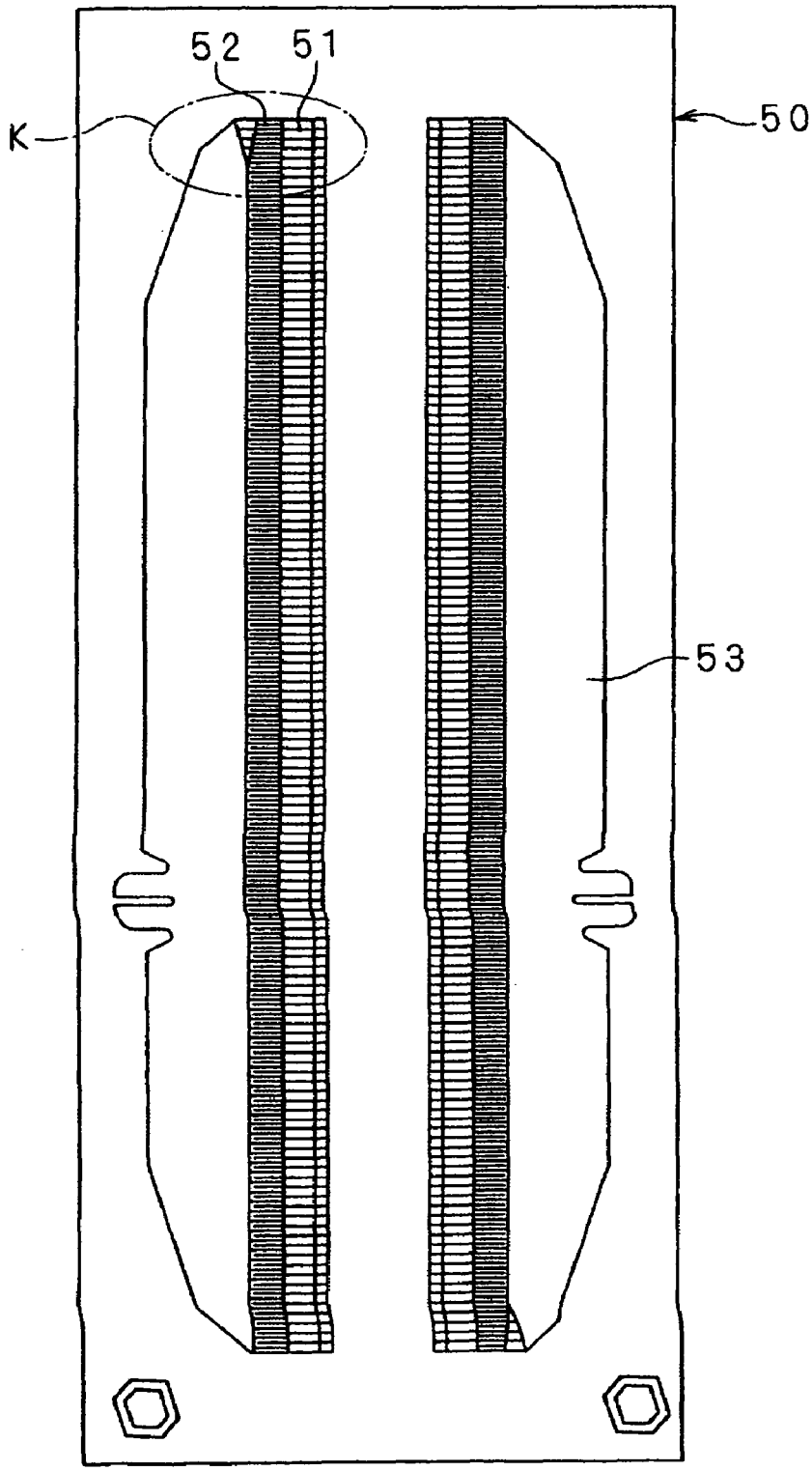
FIG. 8 is a plan view showing a related art flow path forming substrate.
Figure 9:
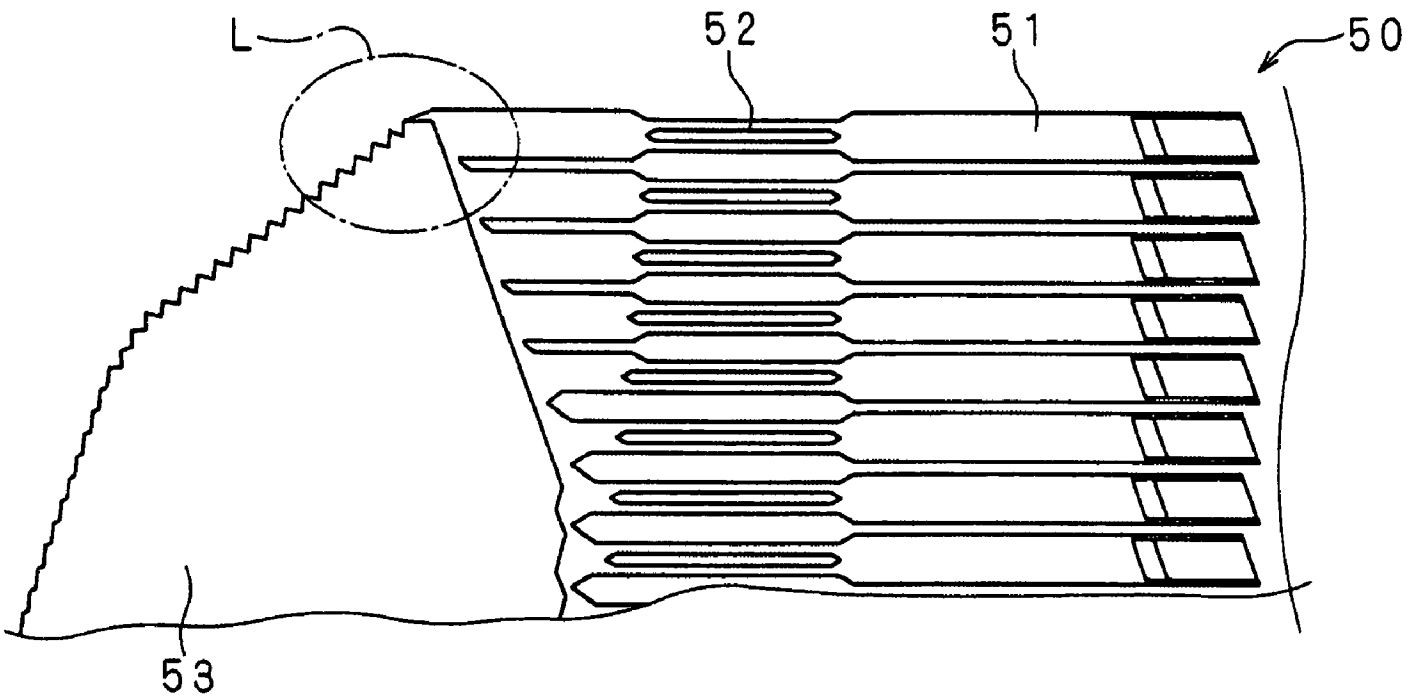
FIG. 9 is a plan view showing a main portion of the related art flow path forming substrate.
Figure 10A:
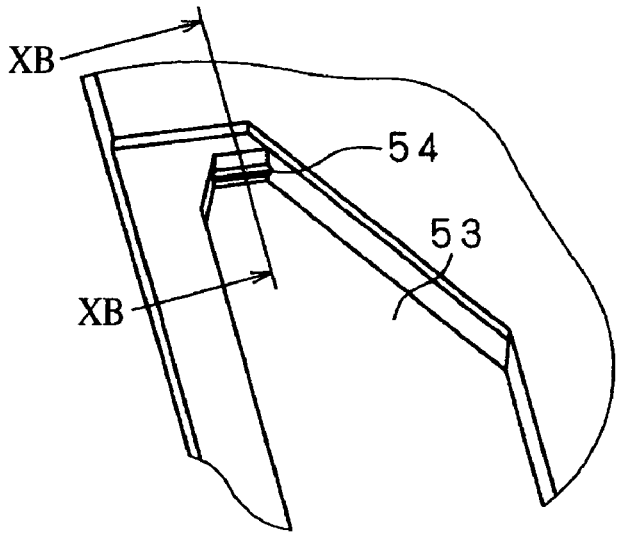
FIG. 10A is a perspective view showing a main portion of the related art flow path forming substrate and FIG. 10B is a section view taken along the line XB-XB in FIG. 10A.
Figure 10B:
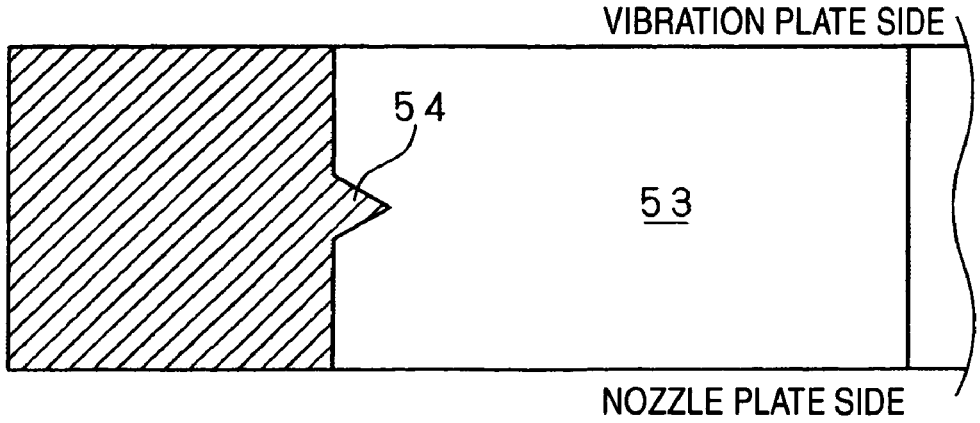
Figure 11A:
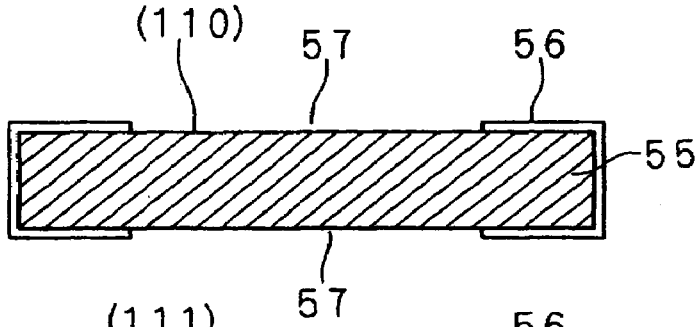
FIGS. 11A to 11D are production step diagrams showing a production method of the related art flow path forming substrate.
Figure 11B:
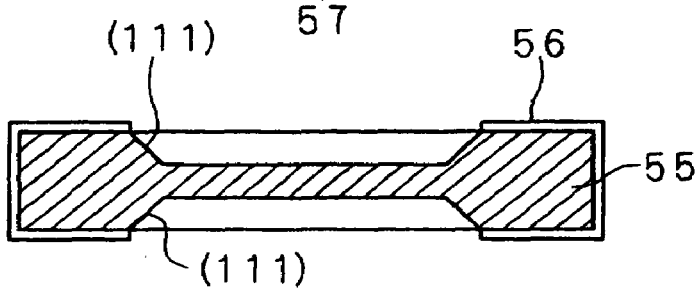
Figure 11C:
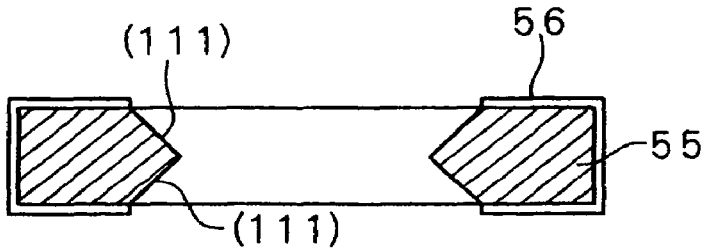
Figure 11D:
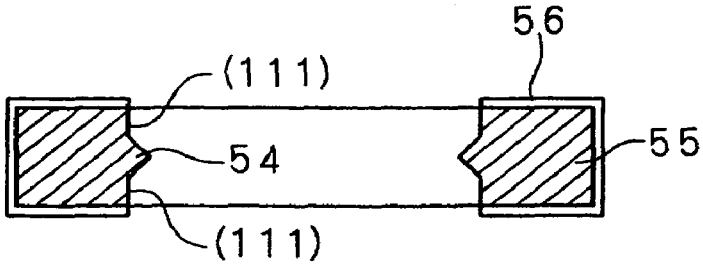

As shown in FIG. 7E, when the etching further advances, the ink reserving chambers 17 are formed as penetrating portions: At this time, the projections 47 are caused to completely vanish by the etching, and the inner wall faces of the ink reserving chambers 17 are configured by appearance of the two (111) planes perpendicular to the (110) plane, and the step portions 30 which are formed by appearance of the (111) plane inclined by about 35 deg. with respect to the plane of crystal plane orientation of (110) are formed in a position corresponding to about one half of the thickness of the flow path forming substrate 11. The step portions 30 are formed as inclined faces which are downward inclined toward the nozzle plate 10, and are steps in which an inner wall face of the flow path forming substrate 11 on the side of the nozzle plate 10 is inward projected.

Thereafter, the etching protective film 41 is removed away by hydrogen fluoride, and thermal oxidation is again conducted to form a silicon dioxide film which has a thickness (for example, about 1 μm) sufficient as a protective film over the whole exposed face, and the film is used as a protective film against the ink, with the result that the flow path forming substrate 11 is obtained.

To the thus formed flow path forming substrate 11, the nozzle plate 10 and the vibration plate 12 are stacked and joined to form the flow path unit 26. The flow path unit 26 is joined with the head case 16, and the piezoelectric vibrators 14 are incorporated to obtain the recording head 1 of the invention (see FIGS. 1 and 2).

According to the above-described production method of the invention, the step portion 30 which extends in the plate face direction of the substrate is formed by anisotropic etching on the inner wall face of the ink reserving chamber 17 to relax stress concentration in the inner wall portion of the ink reserving chamber 17, whereby the flow path forming substrate 11 is prevented from being broken in handling in production steps or the like, so that the production yield is improved. Unlike the conventional art, a projection is not formed, but the step portion 30 is formed. In the obtained ink ejection head 1, therefore, the liquid flow is smoothened, and the air bubble discharging property in forced suction is improved.

Since the step portion is formed by appearance of a (111) plane which is inclined with respect to the (110) plane, the step portion 30 can be easily formed by anisotropic etching of the monocrystal silicon substrate 40, and the step portion 30 is formed as an inclined face. Therefore, a corner formed by the step portion 30 and the inner wall face is increased, and the effect of relaxing stress concentration is enhanced.

The step portion 30 is formed by, when a pattern of the etching protective film 41 is formed on the sides of the one and other faces of the flow path forming substrate 11 and the ink reserving chamber 17 is formed by anisotropically etching the etching regions 45, 46 of the both faces, performing the anisotropic etching in the state where the boundary between the etching protective film 41 and the etching region 45 on the side of the one face is shifted from that between the etching protective film 41 and the etching region 46 on the side of the other face. In this case, the formation of the step portion 30 by anisotropically etching the both faces of the monocrystal silicon substrate 40 is conducted in a relatively easy manner.

The boundary between the etching protective film 41 and the etching region 46 on the face on the side of the nozzle plate 10 is placed to be shifted with respect to the boundary between the etching protective film 41 and the etching region 45 on the face on the side of the vibration plate 12, toward the region which is to be formed as the ink reserving chamber 17, thereby forming the step portion 30 as the step in which the inner wall face of the flow path forming substrate 11 on the side of the nozzle plate 10 is inward projected. In this case, the formation of the step portion 30 by anisotropically etching the both faces of the monocrystal silicon substrate 40 is conducted in a relatively easy manner.

In the thus obtained recording head 1, the step portion 30 which extends in the plate face direction of the substrate is formed on the inner wall face of the ink reserving chamber 17. Therefore, stress concentration in the inner wall portion of the ink reserving chamber 17 is relaxed, and the flow path forming substrate 11 is prevented from being broken in handling in production steps, so that the production yield is improved. Unlike the conventional art, a projection is not formed, but the step portion 30 is formed. Therefore, the liquid flow is smoothened, and the air bubble discharging property in forced suction is improved.

The flow path forming substrate 11 is formed by the monocrystal silicon substrate 40 in which the plane of crystal plane orientation of (110) is the surface, and the step portion 30 is formed by appearance of the (111) plane which is inclined with respect to the (110) plane. Therefore, the step portion 30 can be easily formed by anisotropic etching of the monocrystal silicon substrate 40, or the like, and the step portion 30 is formed as an inclined face. Therefore, a corner formed by the step portion 30 and the inner wall face is increased, and the effect of relaxing stress concentration is enhanced.

The step portion 30 is formed by the inclined plane which is downward inclined toward the nozzle plate 10. Therefore, a downward inclined face along the flow of the ink is obtained, and the ink flow is smoothened, so that the air bubble discharging property in forced suction is improved.

In the case where the step portion 30 is a step in which the inner wall face of the flow path forming substrate 11 on the side of the nozzle plate 10 is inward projected, the formation of the step portion 30 by anisotropic etching the both faces of the monocrystal silicon substrate 40 is conducted in a relatively easy manner. Furthermore, the ink flow is smoothened, and the air bubble discharging property in forced suction is improved.

The step portion 30 is formed in the end portion of the ink reserving chamber 17 in the direction of the nozzle row 25. Therefore, the end portion is a place where breakage due to stress concentration easily occurs, and hence a high effect that breakage of the flow path forming substrate 11 is prevented from occurring by relaxing stress concentration in the portion is attained. Since the end portion is a place where the air bubble discharging property easily becomes problematic, the effect that the ink flow is smoothened and the air bubble discharging property in forced suction is improved is remarkably produced.

The step portion 30 is formed in the farthest end portion 33 which is formed by tapering the end region of the ink reserving chamber 17. Therefore, the farthest portion 33 is a place where breakage due to stress concentration easily occurs, and hence a high effect that breakage of the flow path forming substrate 11 is prevented from occurring by relaxing stress concentration in the portion is attained. Since the farthest portion 33 is a place where the air bubble discharging property easily becomes problematic, the effect that the ink flow is smoothened and the air bubble discharging property in forced suction is improved is remarkably produced.

In the ink reserving chamber 17, the inner wall face is formed by appearance of two (111) planes perpendicular to the plane of crystal plane orientation of (110), and the step portion 30 is formed in the boundary portion between the straight plane 31 in which one of the two (111) planes perpendicular to the plane of crystal plane orientation of (110) appears straight, and the step plane 32 in which the two (111) planes perpendicular to the plane of crystal plane orientation of (110) appear in a step-like manner. In the boundary portion between the straight plane 31 and the step plane 32, therefore, cracks are easily formed along the (111) plane of the straight plane 31. Consequently, a high effect that breakage of the flow path forming substrate 11 is prevented from occurring by relaxing stress concentration in the portion is obtained.

In the above, the flow path forming substrate 11 in which the two nozzle rows 25 and the two ink reserving chambers 17 are disposed has been described. The invention is not restricted to this. The invention can be applied also to a flow path forming substrate 11 in which three or more nozzle rows 25 and three or more ink reserving chambers 17 are formed, and a flow path forming substrate 11 in which a plurality of nozzle rows 25 communicate with a corresponding number of ink reserving chambers 17. Also in this case, the same effects are attained.

In the above, the embodiments in which the recording head 1 comprises the piezoelectric vibrators 14 of the longitudinal vibration mode have been described. The invention is not restricted to them. The invention can be applied also to a recording head 1 which comprises piezoelectric vibrators 14 of the flexural vibration mode, and to a recording head 1 of the bubble jet (registered trademark) type in which piezoelectric vibrators are not used as pressure generating means and air bubbles are generated by heating a liquid in pressure generating chambers.

The invention can be applied to a liquid ejection apparatus. A typical example of such an apparatus is an ink-jet recording apparatus comprising the ink-jet recording head 1 for recording an image. Other examples of a liquid ejection apparatus are: an apparatus comprising a color material ejection head which is used for producing a color filter of a liquid crystal display or the like; an apparatus comprising an electrode material (conductive paste) ejection head which is used for producing electrodes of an organic EL display, a field emission display (FED), or the like; an apparatus comprising a bioorganic ejection head which is used for producing a biochip; and an apparatus comprising a sample ejection head serving as a precision pipette.

What is claimed is:

1. A liquid ejection head comprising:

a flow path forming substrate having a first surface and a second surface opposite to each other and formed with a space, including a liquid reserving chamber and pressure generating chambers, the liquid reserving chamber being so formed as to communicate with each of the pressure generating chambers and to penetrate from the first surface to the second surface;

a nozzle plate, stacked on the first surface and provided with nozzle openings each of which is communicated with one of the pressure chambers; and a sealing plate, stacked on the second surface and adapted to seal the space, wherein a step is formed on an inner wall of the liquid reserving chamber, wherein the inner wall is perpendicular to an ejection surface of the nozzle plate, and wherein the step is formed such that a first portion of the inner wall, which is closer to the nozzle plate than the sealing plate, is projected with respect to a second portion of the inner wall, which is closer to the sealing plate than the nozzle plate.

2. The liquid ejection head according to claim 1, wherein the step is formed with a plane downwardly inclined toward the nozzle plate.

3. The liquid ejection head according to claim 1, wherein:

the nozzle openings are arrayed in a first direction; and the step is located at an end portion of the liquid reserving chamber in the first direction.

4. The liquid ejection head according to claim 3, wherein the end portion of the liquid reserving chamber is tapered in the first direction.

5. The liquid ejection head according to claim 1, wherein the flow path forming substrate is made of a monocrystal silicon substrate.

6. The liquid ejection head according to claim 5, wherein each of the first surface and the second surface is a crystal plane and the step is formed by additional crystal planes which are inclined with respect to the first surface and the second surface.

7. The liquid ejection head according to claim 6, wherein the step is formed at a boundary between a straight plane formed by one of two of the additional crystal planes that are perpendicular to the first surface and the second surface and a stepwise plane formed by the two crystal planes of the additional crystal planes.

8. A method of producing a liquid ejection head, comprising:

providing a monocrystal silicon substrate having a first surface and a second surface each of which is a crystal plane;

etching the flow path forming substrate anisotropically so as to penetrate from the first surface to the second surface to form a space adapted to be a liquid reserving chamber reserving liquid to be supplied to pressure generating chambers each of which is formed in the flow path forming substrate and is communicated with a nozzle opening; and forming a step on an inner wall of the space while etching the flow path forming substrate, wherein the inner wall is perpendicular to an ejection surface of a nozzle plate stacked on the first surface, the nozzle plate containing the nozzle opening, and wherein the step is formed such that a first portion of the inner wall, which is closer to the nozzle plate than a sealing plate stacked on the second surface, is projected with respect to a second portion of the inner wall, which is closer to the sealing plate than the nozzle plate.

9. The method according to claim 8, wherein the step is formed by additional crystal planes which are inclined with respect to the first surface and the second surface.

10. The method according to claim 8, further comprising placing a first etching protective film on the first surface and a second etching protective film on the second surface such that an etching boundary defined by the first etching protective film and an etching boundary defined by the second etching protective film are offset from each other in a direction parallel to the first surface and the second surface.

11. The method according to claim 8, comprising placing a first etching protective film on the first surface on which the nozzle plate is stacked and a second etching protective film on the second surface on which the sealing plate is stacked thereon such that an etching boundary defined by the first etching protective film is shifted from an etching boundary defined by the second etching protective film in a direction of a region to be the space.

12. The method according to claim 8, wherein:

the nozzle openings are arrayed in a first direction; and the step is located at an end portion of the liquid reserving chamber in the first direction.

13. The method according to claim 12, wherein the end portion of the liquid reserving chamber is tapered in the first direction.

14. The method according to claim 8, wherein the step is formed at a boundary between a straight plane formed by one of two of the additional crystal planes perpendicular to a the first surface and the second surface and a stepwise plane formed by the two crystal planes of the additional crystal planes.

* * * * *